US006672299B2

(12) United States Patent
Proctor

(10) Patent No.: US 6,672,299 B2
(45) Date of Patent: Jan. 6, 2004

(54) ARCHERY QUIVER

(76) Inventor: Robert G. Proctor, Rte. 2 Box 64, Lenore, ID (US) 83501

( * ) Notice: Subject to any disclaimer, the term of this patent is extended or adjusted under 35 U.S.C. 154(b) by 79 days.

(21) Appl. No.: 09/940,843

(22) Filed: Aug. 28, 2001

(65) Prior Publication Data

US 2002/0062826 A1 May 30, 2002

Related U.S. Application Data

(60) Provisional application No. 60/253,662, filed on Nov. 28, 2000.

(51) Int. Cl.[7] ..... F41B 5/06

(52) U.S. Cl. ..... 124/86; 224/916

(58) Field of Search ..... 24/336, 339; 124/25.5, 124/25.7, 86, 88; 248/74.2, 513, 634; 403/291, 391, 396, 397, 399; 224/916

(56) References Cited

U.S. PATENT DOCUMENTS 2,722,958 A * 11/1955 King et al.
4,156,496 A 5/1979 Stinson
4,247,027 A 1/1981 Tardiff
4,252,101 A 2/1981 Spitzke
4,550,891 A * 11/1985 Schaty
4,621,606 A 11/1986 Toth
4,635,611 A 1/1987 Priebe
5,193,725 A 3/1993 Radocy
5,209,441 A * 5/1993 Satoh ..... 248/74.2
5,265,584 A * 11/1993 Judson et al. ..... 124/86
5,331,725 A * 7/1994 Chou
5,566,665 A * 10/1996 Stinson ..... 124/86
5,765,786 A * 6/1998 Gretz
5,934,531 A 8/1999 Jablonic et al.
6,006,734 A 12/1999 Sodaro
6,105,566 A * 8/2000 Tiedemann ..... 124/86
6,158,095 A * 12/2000 Lassiter ..... 24/339
6,408,492 B1 * 6/2002 Sparks et al. ..... 24/336

* cited by examiner

*Primary Examiner*—John A. Ricci
(74) *Attorney, Agent, or Firm*—Brian C. Trask

(57) ABSTRACT

A quickly detachable, modular arrow quiver adapted for mounting to a bow, hip belt, tree stand, or other suitable structure. The quiver typically includes a hood to shield broadheads, and an arrow holder spaced from the hood by a rail. A preferred resilient mount is self-biased to interface along an axis of the rail and hold the quiver in a tool-free, height adjustable position relative to structure on which the mount is installed. The resilient mount and suspended quiver mass act in concert as a vibration dampening system when installed on a bow. The modular quiver may be adjusted for length or appearance by use of different interchangeable rail, arrow holder, or hood components.

28 Claims, 3 Drawing Sheets

ARCHERY QUIVER

PRIORITY CLAIM

This application claims the priority of U.S. provisional patent application Ser. No. 60/253,662, filed Nov. 28, 2000, for "RESILIENT MOUNT".

BACKGROUND OF THE INVENTION

1. Field of the Invention

This invention relates to adapters useful to detachably mount objects in a position relative to other objects. It is particularly directed to archery equipment. One preferred embodiment provides an adjustable, quick-connect mounting system for detachably mounting a quiver to a foundation structure such as a bow, hip belt, tree stand, or the like. In a second preferred embodiment, a flashlight may be detachably mounted relative to a quiver.

2. State of the Art

Quivers are known in the field of archery, and are typically used conveniently and safely to transport one or more arrows with an archer. A bow mounted quiver is disclosed in U.S. Pat. No. 4,247,027 to Tardiff. Detachable bow mounted quivers are disclosed in U.S. Pat. No. 6,006,734 to Sodaro; U.S. Pat. No. 4,635,611 to Priebe; U.S. Pat. No. 4,621,606 to Toth; U.S. Pat. No. 4,252,101 to Spitzke; and U.S. Pat. No. 4,156,494 to Stinton. Quivers also may be mounted on structure other than a bow. A quiver mounted on an archer's leg is disclosed in U.S. Pat. No. 5,934,531 to Jablonic et al. Radocy, in U.S. Pat. No. 5,193,725 discloses a hip mounted quiver.

Certain problems remain unsolved in commercially available quivers. Changing the appearance (e.g. camouflage pattern, color, or quiver length), of a potential customer's desired quiver mounted on a bow currently requires replacing the entire quiver assembly. A vendor must therefore maintain an inventory including a variety of alternate quiver assemblies to satisfy customer change requests. Such an inventory may occupy a considerable storage volume thereby reducing the amount of other items a vendor may keep in stock. Conventional metal or plastic quiver mounts are so stiff that vibration produced by a released bow string is transferred to a quiver and its arrow load, generally producing audible vibrations. Besides the disturbing audible effect on a potential quarry, such vibrations may be variable in nature, and may reduce arrow release repeatability and attendant arrow accuracy. Assembly of a quiver to a stiff mount may undesirably produce an audible "click" which can alert a quarry of a hunter's presence.

While the available quivers perform certain functions adequately, it would be an advance in the art to enhance the modularity of a quiver and to provide tool-free attachment of a quiver to a plurality of different secure mounting arrangements. A quiver-height adjustable mount would be a further advance. It would also be an improvement to incorporate a vibration dampening characteristic in a bow mounted quiver. Furthermore, it would be an improvement to provide a mount and quiver that can be assembled and disassembled in relative quiet.

BRIEF SUMMARY OF THE INVENTION

The present invention may be embodied to provide an apparatus for adjustably and detachably mounting a quiver to a bow, belt, tree stand, or other foundation structure. A preferred quiver is modular in construction to permit exchange of components with alternative components having different size, shape, color, or surface pattern. A preferred quiver mount includes a resilient adapter to enable tool-free, quiet, connection of the bow to the supporting foundation structure. A quiver, suspended from a bow with such a resilient mount, also acts as part of a vibration dampening system.

The invention may be embodied as an apparatus to hold a one object in a position relative to a second object while providing a range of adjustment in the position of the second object along an axis of the first object, The apparatus typically can include a mount adapted for attachment to the second object. The mount may include gripping structure having a memory and arranged to form a tool-free coupling with cooperating gripped structure of the first object. The memory functions to self-bias displaced gripping structure into engagement with gripped structure whereby to generate a resisting force sufficient to hold the first object in position and to resist inadvertent movement along the axis. A mount also may include an actuator portion being adapted for human fingers to displace the gripping structure whereby to facilitate coupling and decoupling of the first object. In certain embodiments of the invention, the first object may be a quiver. The second object can be a bow. An exemplary quiver may include interchangeable components such as: a first hood and a first arrow holder spaced apart from the first hood by a first rail. The first rail can be adapted for removable attachment to the hood. The invention may also be used with a second hood or a second rail having a different appearance from the first hood or rail. Changes in appearance may include different coloration, surface treatments to alter reflectivity, or changes in size, including length. Exemplary rails typically have a pair of substantially parallel edges, such as provided by a plurality of approximately parallel rods. One suitable rail includes a pair of tubular shafts, each of the shafts being adapted at first and second ends to receive threaded fasteners, whereby to attach the hood and an arrow holder. It is currently preferred for the fasteners to be oriented such that an axis of the fasteners is aligned with an axis of the shafts.

The invention can also be embodied as a modular archery quiver, including: a rail removably connected at a first end to a first hood in which to receive arrow heads; and a first arrow holder spaced apart from the first hood by the rail. The first arrow holder typically includes slots adapted in which removably to receive arrow shafts, and the arrow holders may be removably connected to the rail. The quiver can be combined with a mount configured for attachment to a structure from which the quiver is to be suspended, such as a bow, tree stand, or archer's hip. The mount may be adapted for variable engagement along an axis of the rail, whereby to provide a substantially infinite adjustment in mounted position along a portion of the rail axis. Preferred mounts are typically adapted for tool-free engagement and disengagement with the rail. The invention may also include a second mount attached to the rail. In certain circumstances, the rail may be axially discontinuous, thereby forming a multi-piece quiver system. Sometimes a second arrow holder may be included in a quiver. Such second arrow holder may be adapted for variable positioning, between the first arrow holder and the hood, along an axis of said rail. An exemplary modular quiver may include a plurality of interchangeable hoods providing different surface adornment. A quiver according to the invention may also include a plurality of interchangeable rails whereby to form quivers having different lengths between a hood and an arrow holder. Multiple mounts may be provided for attachment to different support structures. Preferred mounts include one or more resilient adapters structured to dissipate vibrational energy from a vibrating bow from which the adapter depends to at least a quiver attached to the mount.

The invention includes an archery quiver and quiver mount, having: a rail connected at a first end to a first hood in which to receive arrow heads; a first arrow holder carried by the rail and spaced apart from the first hood; and a mount configured for attachment to a structure from which the quiver is to be suspended, the mount being adapted for variable engagement along an axis of the rail. The mount may have an actuator portion configured for tool-free human finger actuation whereby to displace gripping structure of the mount to facilitate coupling or decoupling between the mount and the rail. Exemplary mounts include a first and second channel to interface with cooperating rail structure. Openings of the channels may be oriented in nonparallel directions or substantially to face each other. In one currently preferred embodiment, the opening of the channels are oriented substantially transverse to each other. In any case, the mount is desirably configured for releasable attachment to the rail. Suitable rails may include a pair of rods having nominally circular cross-sections and oriented in approximately parallel axial alignment. Useful rod cross-sections are typically between about ¼ and ¾ inches in diameter. Other rails may be formed by any structure having two spaced apart approximately parallel edges adapted for engagement with the mount. Desirable mounts are formed, at least in part, from material having the characteristics necessary to act as a vibration dampening system, in concert with a quiver attached thereto, for a bow on which the mount and quiver are attached. Sometimes first and second foam layers are disposed in the hood, with the second foam layer being removable to adjust for different size arrow tips.

BRIEF DESCRIPTION OF THE SEVERAL VIEWS OF THE DRAWINGS

In the drawings, which illustrate what is currently regarded as the best modes for carrying out the invention.

DETAILED DESCRIPTION OF THE INVENTION

Reference will now be made to the drawings in which the various elements of the invention will be given numerical designations and in which the invention will be discussed so as to enable one skilled in the art to make and use the invention. It is to be understood that the following description is only exemplary of the principles of the present invention, and should not be viewed as narrowing the claims which follow.

Figure 1:
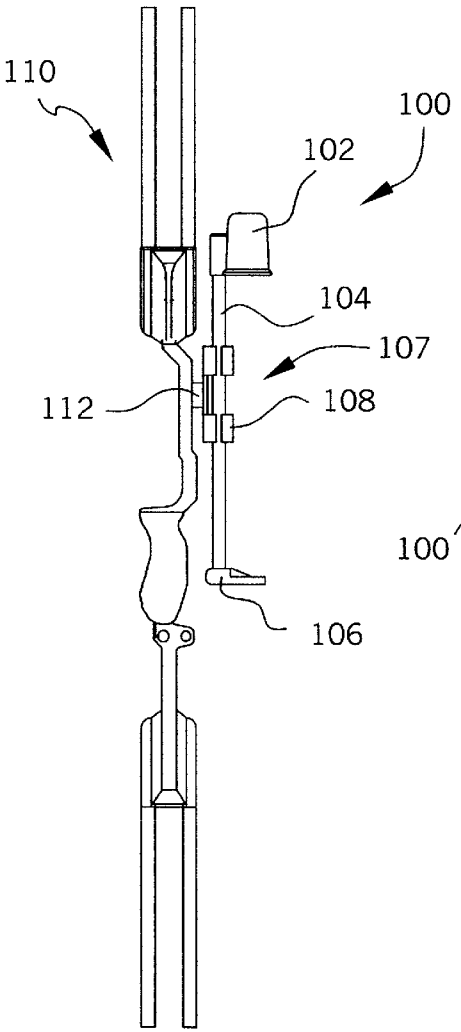
FIG. 1 illustrates a side view of a one-piece modular quiver according to the present invention attached to an archery bow.

One preferred embodiment of the invention is illustrated in FIG. 1, and generally indicated at 100. The quiver 100 is embodied as a one-piece quiver, including a hood 102, rail 104, and an arrow holder 106. The quiver 100 typically is attached by a bow mount 107, having one or more adapters 108, to a bow 110. Sometimes a stand-off 112 of a sufficient length may be used to space the quiver by a desired amount from a bow 110.

Figure 2:
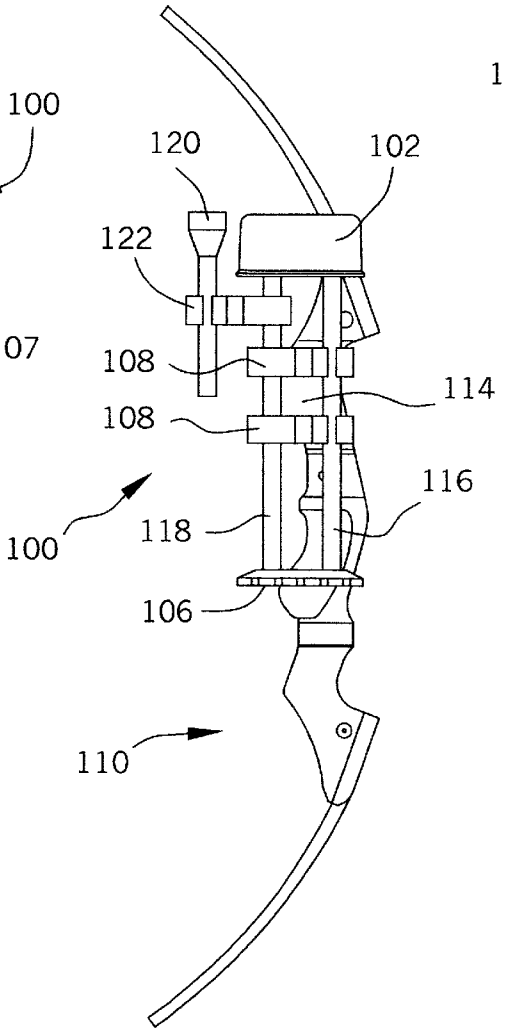
FIG. 2 is a front view of the embodiment of FIG. 1, with an optional flashlight attachment element.

With reference to FIG. 2, it can be seen that certain embodiments of a bow mount 107 may include an intermediate mounting plate 114, or other substrate, on which resilient adapter 108 may be installed. A rail 104 may comprise one or more of a rod, or shaft, 116 and 118. A rail 104 may also comprise any structure providing substantially parallel edges, such as a strap or I-beam. In the illustrated embodiment 100, tubular shafts 116 and 118 are adapted at opposite ends for engagement with fasteners to secure hood 102 and arrow holder 106. A flashlight 120 may be attached to some quiver structure, such as a strut 118, by an optional flashlight adapter 122. Such attachment allows pointing a flashlight 120 simply by orienting a hand-held bow 110. This feature is helpful in reducing the number of items hand-carried to a hunting stand during a walk to the hunting stand. Attachment of the flashlight 120 to a bow also allows the bow to be propped up to light egress to a stand, such as a tree stand, prior to pulling the bow up to the stand on a haul line.

Figure 3:
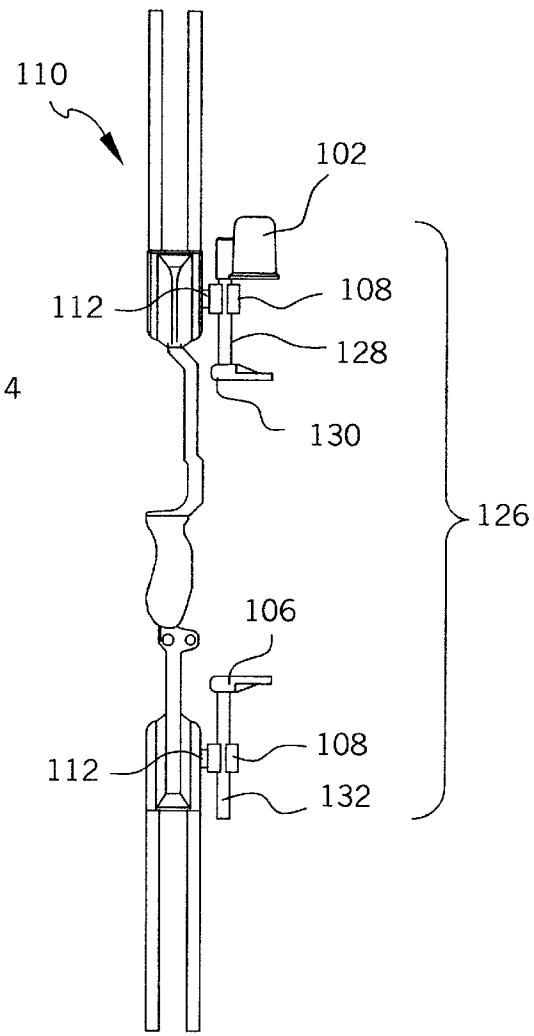
FIG. 3 illustrates a side view of a two-piece modular quiver according to the invention.

An alternative, two-piece, embodiment of the invention, generally indicated at 126, is illustrated in FIG. 3. In such an embodiment, the top piece may include a hood 102, a top rail 128 and an optional arrow rest 130. The bottom piece may include an arrow rest 106 (illustrated positioned on the top of a bottom rail 132). The orientation of the arrow rest 106 may alternatively be on the bottom, or both top and bottom, of shaft 132. It should also be noted that, in this embodiment, an equivalent rail 104 is embodied by an axially discontinuous rail including rails 128 and 132. Again, one or more stand-offs 112 may be included in the mounting hardware to space a quiver 126 from a bow 110.

Figure 4:
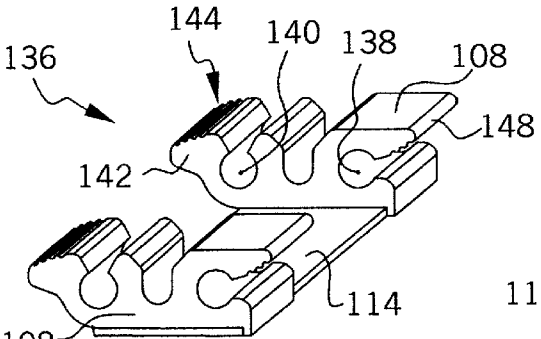
FIG. 4 is a perspective view of a preferred quiver mount with which to suspend a quiver from some structure.

A first preferred quiver mount, generally indicated at 136, is illustrated in FIG. 4. Mount 136 includes more than one resilient adapters 108 spaced apart by a mounting plate 114. In general, adapters 108 may be made from any resilient material having sufficient memory and strength to hold a quiver in position. For purpose of this disclosure, resilient means the material may be arranged such that it can be flexed by human fingers sufficiently to couple and decouple a rail to the adapter.

In use as a vibration isolator, is desirable that an adapter 108 be made from a material, or a combination of materials, having an effective shear modulus, through a section in a plane substantially parallel to a bow, in a range between that of a very soft rubber and a very stiff plastic. It is currently preferred to form adapters from extruded rubber-like material such as EPDM, Sanaprene™, or silicone. Injection molding is also within contemplation. Suitable rubber-like materials for forming adapters may be selected from those having a Durometer value in a range of between about 5 D and about 95 D. It has been found that a rubber of approximately 60 Durometer can form exemplary adapters. In certain applications, such as for operation in cold conditions, silicone may be preferred for its consistent resilience and memory over a wide range of temperature.

Rubber, silicone, and urethane type materials also advantageously have noise muffling characteristics, allowing quick assembly of a quiver to a mount with minimal noise. Such can be a hunt saving feature when moving a quiver from a mount attached to a bow to a tree stand mount. The deflection under shear of an adapter 108 can serve as a spring, with the quiver acting as a mass in a vibration damping system for a bow. Ideally, the adapter deflects in shear to place the quiver out of phase with deflections of the bow, thereby dampening bow vibrations according to classical spring-mass oscillation theory. Plate or substrate 114 may be formed from any suitable metal, plastic, wood, or combination of materials providing sufficient supportive properties conveniently to attach an adapter to a base.

A typical adapter 108 provides one or more channels 138, 140, in which to receive rail structure of a quiver. The illustrated channels 138, 140 are particularly adapted to receive tubular rail structure. Adapters 108 may be formed to accommodate alternative rail structure of different cross-section, including without limitation, rectangular or any other cross-section extruded to provide two substantially parallel edges. However, a rail need not have a self-similar cross-section along its entire length to be operable in the instant invention. It is currently preferred for an adapter 108 to include an actuator portion 142, typically having a grip enhancing surface 144, to assist in enlarging the channel as desired for assembly or disassembly of a rail 104 (FIG. 1) and a mount 136. The portion 142 may also be embodied as an actuator lever 148.

Figure 5:
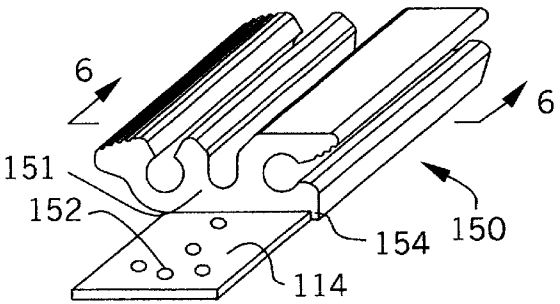
FIG. 5 is an alternative embodiment of a quiver mount.

FIG. 5 illustrates a second preferred embodiment of a quiver mount, generally indicated at 150. Mount 150 has a single adapter 151, which may be of a different length than an alternate adapter 108. In general, an adapter 108,151 may be attached to a substrate 114 by any conventional means, including adhesive bond, structural interference fit, and mechanical fasteners.

A typical mounting plate 114 provides a variety of holes 152 (see FIG. 5) through which fasteners may be secured to a quiver support structure, such as a bow, tree stand, or hip quiver. The variety of holes 152 provides an adjustment in the orientation of a quiver with respect to the support structure. An adapter may also be applied to a quiver support structure directly, without any intermediary substrate 114. In certain embodiments, it is preferred to include an alignment tab 154 to assist in assembly of an adapter to a foundation. An adapter 108, 151 may also be of use as a separate and individual component, e.g. to hold a flashlight, or a wind tester or other tool, in a substantially fixed position relative to a support structure. In one such function, a flashlight 120 may be secured by the adapter 108, 151 to a quiver strut (see FIG. 2). It should be noted that a mounting plate 114 may extend beyond the perimeter of an adapter in any or all directions, as partially illustrated between FIGS. 4–6.

Figure 6:
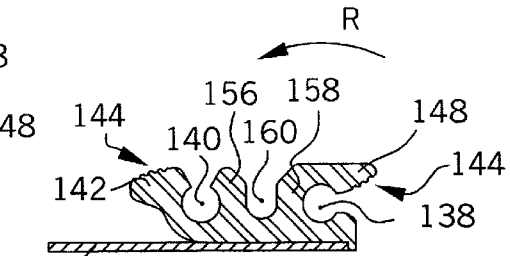
FIG. 6 is a cross-section view of the embodiment illustrated in FIG. 5, taken through section 6—6 and looking in the direction of the arrows.

With reference to FIG. 6, attachment of rail structure 104 such as carried by quiver 100 (FIG. 2) will be described. As a first step, first rod 116 is inserted into channel 138. During this step, actuator lever 148 may be displaced (e.g. vertically) to ease entry of shaft 116 into reception in channel 138 as desired. Also, shaft 118 may be positioned substantially vertically above shaft 116 for convenience. As a second step, rail 104 is rotated as indicated by arrow R, bringing shaft 118 into alignment with channel 140. In a third step, actuator 142 may be displaced to ease insertion of shaft 118 into reception in channel 140. Arms 156 and 158 are typically biased into engagement with shafts 116, 118 when the rail 104 is in installed position. A channel or space 160 is typically provided to facilitate deflection of arms 156 and 158.

Decoupling of a rail 104 and a mount 136, 150 is accomplished simply by reversing the assembly steps. Similar procedures are typically employed with alternative embodiments of adapters and quiver mounts according to the invention. That is, adapter structure may be biased out of an assembled position by human fingers to ease insertion of rail structure into engagement with adapter structure. There is generally a component of rail rotation during the tool-free assembly process. The rail 104 may be affixed to the mount 136, 150 at convenient different places along the axis of rods 116, 118. An attached quiver may also advantageously be repositioned by sliding along the axis of a rail 104. Preferred embodiments of mounts and rails provide a virtually infinite adjustment in mounting location along at least a portion of the rail axis.

Figure 10:
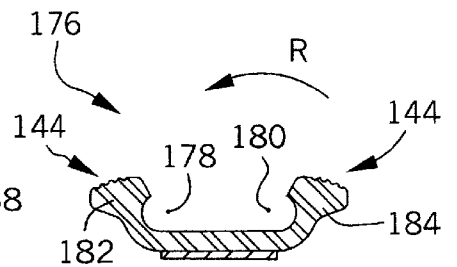
FIG. 10 is a cross-section, similar to that illustrated in FIG. 6, but taken through yet another alternative embodiment of a quiver mount.
Figure 9:
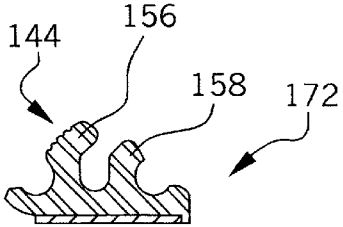
FIG. 9 is a cross-section, similar to that illustrated in FIG. 6, but taken through the alternative embodiment of a quiver mount illustrated in FIG. 7.
Figure 8:
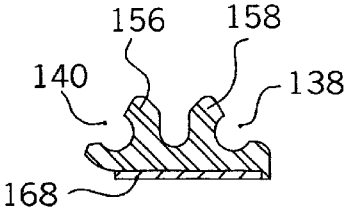
FIG. 8 is a cross-section, similar to that illustrated in FIG. 6, but taken through an alternative embodiment of a quiver mount.
Figure 7:
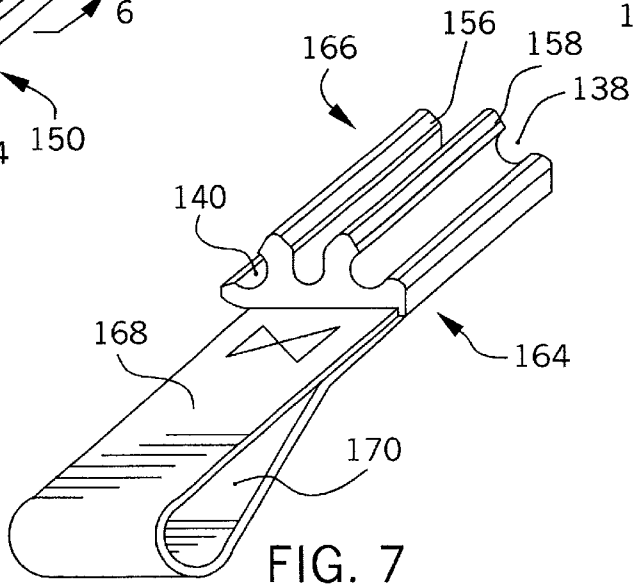
FIG. 7 is a perspective view of an alternative embodiment of a quiver mount adapted for suspension from a belt.

FIGS. 7 and 8 illustrate an alternative quiver mount 164 and an alternative adapter 166 configured to be carried on base 168. Base 168 is adapted for wearing on an archer's belt, which may be passed through belt loop 170. Adapter 166 may be rotated with respect to base 168, to orient a quiver in a desired direction. Certain embodiments of a base 168 may extend beyond the perimeter of the adapter in any or all directions. The height of the quiver may advantageously be adjusted by sliding adapter 166 axially along the quiver rail, or by remounting the adapter in engagement with a different portion of the rail. Examples of other alternative cross-sections for adapter structure 172, 176 are illustrated in FIGS. 9 and 10. In FIG. 9, arm 156 is adapted to carry a grip enhancing surface 144 to enhance its performance as a displacement actuator structure.

In FIG. 6, channel 138 is arranged to open substantially transverse to the direction in which channel 140 opens. With reference to FIGS. 8 and 9, channels 138 and 140 have openings directed in nonparallel directions. Channels 178 and 180 illustrated in FIG. 10 have openings oriented substantially to face each other. Both of arms 182 and 184 (FIG. 10) are illustrated as carrying grip enhancing structure 144, although such is not required. It is, however, preferred that at least one of arm 182, 184 perform such a function. While the embodiments of FIGS. 6, 8, and 9 are arranged to bias substantially against the inside parallel gripped portion of a rail structure, arms 182 and 184 carrying channels 178 and 180 are adapted substantially to bias against the outside parallel portion of gripped rail structure.

Figure 10A:
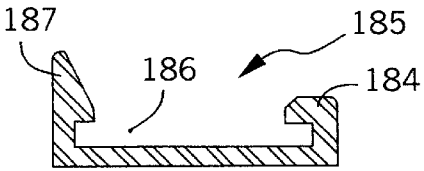
FIG. 10A is a cross-section of another alternative configuration for a resilient mount.

Arms 182 and 184 in FIG. 10 may variously be structured more closely to correspond to a cooperating shape of alternate rail structure, as illustrated by a cross-section through alternative resilient mount 185 in FIG. 10A. For example, channels 178 and 180 illustrated in FIG. 10 may be formed to complement a rectangular cross-section 186, whereby to correspond to existing commercial quiver bracketry. Such an arrangement would permit an archer to apply a resilient mount 185 according to the instant invention to his existing quiver rail structure. Many commercial quiver mounting rail structures are fashioned similar to a rectangular strap. The resilient mount according to the instant invention could provide the benefits of a vertically adjustable, quietly removable, vibration isolating and dampening, quiver mount to the archer's tackle at a minimum cost.

In the illustrated adapter embodiments, assembly of rail structure into engagement with a resilient mount may best be accomplished with a rotational component indicated by arrow R in FIGS. 6 and 10. Of course arms, such as either or both of arms 182 and 184, may be formed as a lever arm 187 (see FIG. 10A) to increase leverage to permit an archer more easily to bias the arm to a displaced position to facilitate quiver assembly to, or removal from, a bow or other structure.

Figure 11:
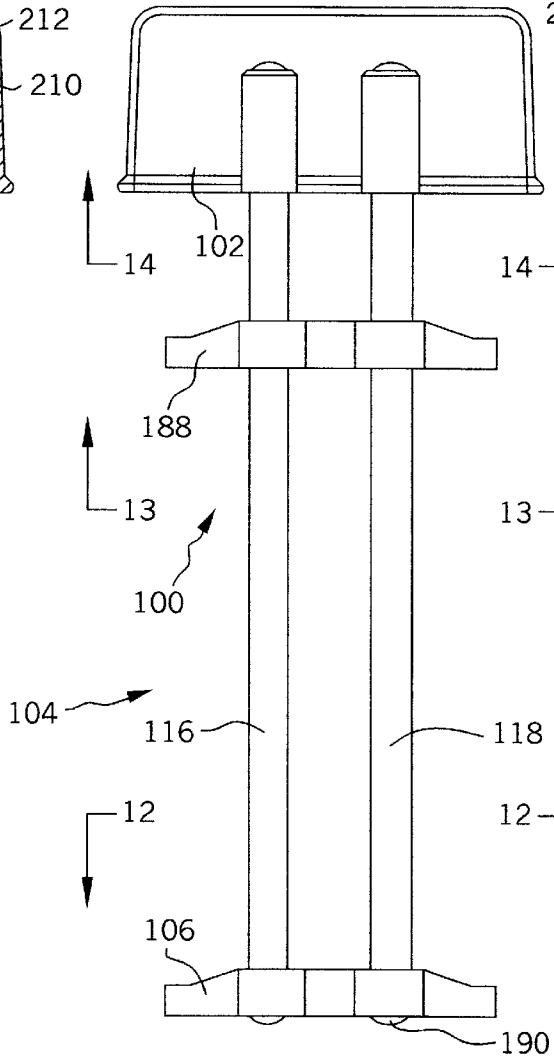
FIG. 11 is a rear view of a modular quiver according to the invention.

An exemplary quiver according to the invention is illustrated in FIG. 11, and is generally indicated at 100. This quiver 100 includes a hood 102, a rail 104 formed from shafts 116 and 118, and an arrow holder 106. One or more optional arrow holder 188 may additionally be included, as illustrated. It is currently preferred that quiver 100 be modular, in that rail 104 may be removed from a hood 102 for replacement with an alternate hood 102 having a different surface pattern or color. Typical surface patterns include camouflage patterns such as the Real Tree™ patterns including Advantage, Hardwoods, Extra Grey, Mossy Oak Forest Floor, and Break-up, among others.

An advantage provided by the invention is that a vendor may change a quiver assembly to meet a customer's specifications simply by switching certain components. The vendor therefore only need maintain a component supply of reduced volume compared to entire quiver assemblies. The required storage volume of disassembled components of the invention can be significantly reduced by nesting components such as hoods 102, and stacking arrow holders 106 and 188. Shafts 116, 118 forming preferred rails 104 can be bundled for efficient use of space.

Modularity of components forming the illustrated quiver 100 is facilitated by use of threaded fasteners 190 to secure hood 102 and arrow holder 106 to rail 104. Threaded fasteners allow multiple changes between components such as hood 102, rail 104, and arrow holder 106. In the illustrated embodiment, fasteners 190 are aligned with the axis of shafts 116 and 118. Other removable fastening arrangements are also workable to form a modular quiver. For example, fasteners may be provided with the axis of a fastener oriented substantially transverse an axis of a rail. Optional arrow holder 188 may be arranged to slide along a rail 104, and employ a friction fit to resist changes in position on the rail 104.

Figure 13:
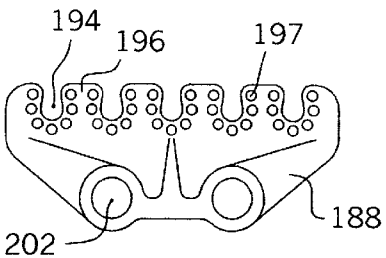
FIG. 13 is a view of a portion of the embodiment illustrated in FIG. 11, taken through section 13—13 and looking in the direction of the arrows.
Figure 12:
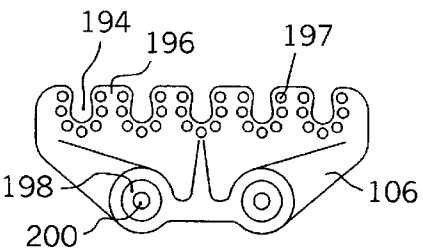
FIG. 12 is a view of a portion of the embodiment illustrated in FIG. 11, taken through section 12—12 and looking in the direction of the arrows.

FIGS. 12 and 13 illustrated additional details of construction of typical arrow holders 106 and 188. Each arrow holder typically provides multiple slots 194 in which arrow shafts may be received. Slots 194 are defined between flexible fingers 196. Holes 197 may be present to increase a range of size diameter in arrow shaft that can be accommodated within a slot 194. Arrow holder 106 may have a socket 198 to receive an end of a shaft, such as shaft 116. A through-hole 200 is typically provided to accommodate a fastener 190. The arrow holder 188 may have one or more through-holes 202 sized to fit to a shaft 116, 118, or may employ some other attachment arrangement, such as gripping structure similar to such structure illustrated by adapter 166.

Arrow holders are typically formed from a stiffening plate injection over-molded with a flexible material. Exemplary shafts 116, 188 may advantageously be formed from Aluminum tubes, and may include a press-fit threaded adapter at each end in which to receive a fastener 190. Hoods 102 may be formed by injection molding various plastics or other suitable material. A rail 104, or a hood 102, may be painted, or have alternative surface adornment including various camouflage or colored patterns, and also assorted textures to reduce reflected light.

Figure 14:
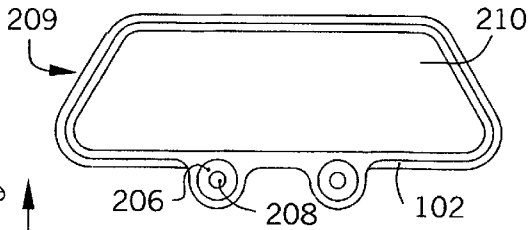
FIG. 14 is a view of a portion of the embodiment illustrated in FIG. 11, taken through section 14—14 and looking in the direction of the arrows.
Figure 15:
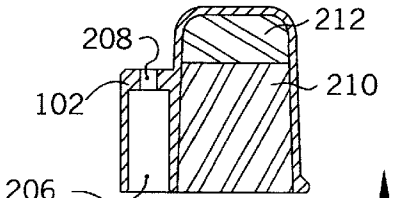
FIG. 15 is a cross-section view of the embodiment of FIG. 14, taken through section 15—15 and looking in the direction of the arrows.
Figure 16:
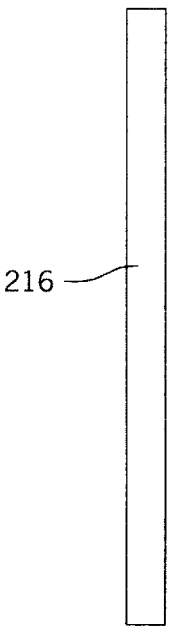
FIG. 16 illustrates an alternative replacement rail component having a different length.

A typical hood 102 is best illustrated in FIGS. 14 and 15. A socket 206 may be provided in which to receive an end of shaft 116. Through-hole 208 may also be included for a fastener 190. Open end 209 of hood 102 reveals a foam layer 210, in which to bury broad head, or other type, arrow tips (not illustrated). Foam layer 210 advantageously may be provided as a removable layer to accommodate mechanical, or opening, arrow tips in a second foam layer 212. Therefore, arrow tips of various types, including points, single blade, multi-blade, or mechanically active, may be received in hood 102 by a suitable arrangement of the one or more foam layers.

It should be noted that quivers having different length rails 104 may be formed simply by replacing component shafts 116, 118 with a pair of shafts 216 of a different length. Shafts 116, 118 are typically between ¼ and ¾ inches in diameter. Typically, rails of about 13 inches in length may be provided for a primarily bow-mounted quiver. A quiver designated primarily for belt mounting, or for use in a tree stand, may be provided with a rail of perhaps only 6 inches in length. When hip mounted, such as suspended from a belt, the height of quiver mounting may be changed, by adjusting gripping position of the mount along the rail axis, to accommodate height of brush through which an archer is walking. If the brush becomes too tall or thick, the archer may advantageously remove his quiver from the belt mount, and place it onto the bow mount.

While the invention has been described in particular with reference to certain illustrated embodiments, such is not intended to limit the scope of the invention. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus to hold a quiver in a position relative to a second object while providing a range of adjustment in said position along an axis of said quiver, said apparatus comprising:

a mount adapted for attachment to said second object, said mount comprising gripping structure having a memory and arranged to form a tool-free coupling, with cooperating gripped structure of said first object, operable to generate a resisting force sufficient to hold said quiver in said position and to resist inadvertent movement along said axis; and an actuator portion of said mount being adapted for human fingers to displace said gripping structure whereby to facilitate said coupling and decoupling.

2. The apparatus of claim 1, in combination with a said second object comprising a bow.

3. The apparatus of claim 1, said quiver comprising interchangeable components including: a first hood and a first arrow holder spaced apart from said first hood by a first rail, said first rail being adapted for removable attachment to said hood.

4. The apparatus of claims 3, combination with a second hood having a different appearance from said first hood.

5. The apparatus of claim 3, in combination with a second rail having a different appearance from said first rail.

6. The apparatus of claim 3, said first rail comprising a pair of substantially parallel edges.

7. The apparatus of claim 3, said first rail comprising a plurality of rods.

8. The apparatus of claim 3, said first rail comprising a pair of tubular shafts, each of said shafts being adapted at first and second ends to receive threaded fasteners, whereby to attach said first hood and said arrow holder.

9. The apparatus of claim 8, said shafts being adapted at first and second ends to receive said threaded fasteners oriented with an axis of said fasteners aligned with an axis of said shafts.

10. A modular archery quiver, comprising:

a plurality of interchangeable hoods providing different surface adornments and in which to receive arrow heads;

a rail adapted for nondestructive connection, removal, and reconnection at a first end to a first one of said interchangeable hoods; and a first arrow holder spaced apart from said first one hood by said rail, said first arrow holder comprising slots adapted in which removably to receive arrow shafts.

11. The quiver according to claim 10, wherein said first arrow holder is adapted for nondestructive connection, removal, and reconnection to said rail.

12. The quiver according to claim 11, in combination with:

a mount configured for attachment to a structure from which said quiver is to be suspended, said mount further being adapted for variable engagement along an axis of said rail, whereby to provide an adjustment in mounted position along said rail axis.

13. The combination according to claim 12, said mount being adapted for tool-free engagement and disengagement with said rail.

14. The combination according to claim 12, further comprising:

a second mount attached to said rail; and wherein said rail is axially discontinuous, thereby forming a multi-piece quiver system.

15. The combination according to claim 12, further comprising:

a second arrow holder adapted for variable engagement, between said first arrow holder and said one hood, along an axis of said rail.

16. The quiver according to claim 10, in combination with a plurality of interchangeable rails whereby to form quivers having different lengths between a said one hood and a said arrow holder.

17. The quiver according to claim 10, in combination with a plurality of mounts, said mounts being adapted for attachment to different support structures and for variable tool-free engagement along an axis of said rail.

18. The quiver according to claim 10, in combination with a resilient adapter structured to dissipate vibrational energy from a vibrating bow on which said adapter is mounted to at least a quiver attached to said mount.

19. An archery quiver and quiver mount, comprising:

a rail connected at a first end to a first hood in which to receive arrow heads;

a first arrow holder carried by said rail and spaced apart from said first hood; and a mount configured for attachment to a structure from which said quiver is to be suspended, said mount being adapted for self-biased variable engagement along an axis of said rail.

20. The combination of claim 19, said mount further comprising:

an actuator portion configured for tool-free human finger actuation whereby to displace gripping structure of said mount to facilitate coupling or decoupling of said mount and said rail.

21. The combination of claim 20, wherein: said rail comprises a structure having two spaced apart approximately parallel edges adapted for engagement with said mount.

22. The combination of claim 19, said mount further comprising:

a first and second channel, openings of said channels being oriented in nonparallel directions.

23. The combination of claim 19, said mount further comprising:

a first and second channel, openings of said channels being oriented substantially to face each other.

24. The combination of claim 19, said mount further comprising:

first and second channels, the opening of said first channel being oriented substantially transverse the direction in which said second channel opens.

25. The combination of claim 19, said mount being configured for releasable attachment to said rail.

26. The combination of claim 19, wherein:

said rail comprises a pair of rods having nominally circular cross-sections and oriented in approximately parallel axial alignment, said cross-sections being between about ¼ and ¾ inches in diameter.

27. The combination of claim 19, wherein:

said mount comprises material having the characteristics necessary to act as a vibration dampening system, in concert with a said quiver attached thereto, for a bow on which said mount and quiver are attached.

28. The combination of claim 19, further comprising:

first and second foam layers disposed in said hood; said second foam layer being removable to adjust for different type arrow tips.

* * * * *